US011501935B1

(12) United States Patent
Hu et al.

(10) Patent No.: US 11,501,935 B1
(45) Date of Patent: Nov. 15, 2022

(54) SENSOR SYSTEM FOR MEASURING ANGLE OF GATE OF ISOLATING SWITCH OF OVERHEAD LINES

(71) Applicant: EAST CHINA JIAOTONG UNIVERSITY, Nanchang (CN)

(72) Inventors: Jun Hu, Nanchang (CN); Yong He, Nanchang (CN); Liang Yang, Nanchang (CN); Fan Xu, Nanchang (CN)

(73) Assignee: EAST CHINA JIAOTONG UNIVERSITY, Nanchang (CN)

( * ) Notice: Subject to any disclaimer, the term of this patent is extended or adjusted under 35 U.S.C. 154(b) by 0 days.

(21) Appl. No.: 17/870,771

(22) Filed: Jul. 21, 2022

Related U.S. Application Data

(63) Continuation of application No. PCT/CN2020/129766, filed on Nov. 18, 2020.

(30) Foreign Application Priority Data

Jan. 30, 2020 (CN) ..... 202010077510.4

(51) Int. Cl.
*H01H 33/59* (2006.01)

(52) U.S. Cl.
CPC ..... *H01H 33/596* (2013.01)

(58) Field of Classification Search
CPC ..... G01D 5/347; G01J 3/0245; G05B 2219/15017; G05B 2219/25197; G05B 2219/33189; G05B 2219/33205; G05B 2219/37279; G05B 2219/37287; H01H 2219/0621; H01H 33/596; H01H 9/16; H02B 13/025; H02J 13/00017
See application file for complete search history.

(56) References Cited

FOREIGN PATENT DOCUMENTS

| | | | |
|---|---|---|---|
| CN | 102323542 | A | 1/2012 |
| CN | 202342034 | U | 7/2012 |
| CN | 103487077 | A | 1/2014 |
| CN | 103618387 | A | 3/2014 |

(Continued)

OTHER PUBLICATIONS

InternationaL Search Report issued in corresponding International application No. PCT/CN2020/129766, dated Feb. 22, 2021.

(Continued)

*Primary Examiner* — Jared Fureman
*Assistant Examiner* — Nicolas Bellido

(57) ABSTRACT

A sensor system for measuring an angle of a gate of an isolating switch of overhead lines, comprising an optical fiber angle sensor, a base, a support plate, a light source fiber, a laser transmitter, an aluminum box, a relay, a step-down power module, a control circuit board, a photoelectric converter, and a receiving optical fiber. The support plate is arranged on an upper part of a pillar insulator; the optical fiber angle sensor is arranged on the base to detect a rotation angle of the gate; the laser transmitter is controlled to emit a laser beam into the light source fiber; the laser beam is received by the receiving optical fiber and transmitted to the photoelectric converter to convert a light intensity into a voltage signal; the converted voltage signal is transmitted to the control circuit board for processing, and the angle of the gate is output.

3 Claims, 4 Drawing Sheets

(56) References Cited

FOREIGN PATENT DOCUMENTS

| | | | | | |
|---|---|---|---|---|---|
| CN | 107917681 | A | | 4/2018 | |
| CN | 108317971 | A | * | 7/2018 | |
| CN | 209249317 | U | | 8/2019 | |
| CN | 111238407 | A | | 6/2020 | |
| CN | 112781528 | A | * | 5/2021 | |
| JP | S63238428 | A | | 10/1988 | |
| WO | 0118492 | A1 | | 3/2001 | |
| WO | WO-2021151340 | A1 | * | 8/2021 | ..... G01B 11/26 |

OTHER PUBLICATIONS

Written Opinion of the International Search Authority in corresponding International application No. PCT/CN2020/129766.
Zhaojie Tan, Cui Meng: "Design and Implementation of Electromagnetic Compatibility for Optical Receiver", ((Journal of Hebei University of Science and Technology)) , pp. 51, 52, 55.
Meihua Guan:"((Numerical Control Technology—Principle and Modern Control System))", pp. 184-189.

* cited by examiner

SENSOR SYSTEM FOR MEASURING ANGLE OF GATE OF ISOLATING SWITCH OF OVERHEAD LINES

TECHNICAL FIELD

The present disclosure relates to the technical field of angle measurement of an isolating switch, and in particular to a sensor system for measuring an angle of a gate of an isolating switch of overhead lines.

BACKGROUND

Overhead lines' isolating switch is one of widely used electrical devices for electrified railroads, which can operate a circuit system without load to form isolated disconnection points to ensure the safety of the power supply when a train changes phase. When the isolating switch is opened, it is necessary to ensure that there is sufficient pull-off angle between movable and static contacts, as well as to ensure the safety of the electrical device and maintenance staff adjacent to the isolating switch. When the isolating switch is closed, it is necessary to ensure that there is sufficient contact area between the movable and static contacts to achieve a state of closing in place. Therefore, whether the overhead lines' isolating switch can be opened and closed in place directly affects the safety of train operation. Therefore, it is necessary to monitor the gate angle of the isolating switch to ensure that the isolating switch is in place during opening and closing operations.

An existing method for measuring the isolating switch of the overhead lines mainly include: 1. Applying an image recognition method, which obtains a position of the gate of the isolating switch by image processing, and calculates the current angle of the gate, while this method is easily affected by weather and leads to a high false detection rate. 2. Applying an angle measurement method based on a photoelectric encoder; the photoelectric encoder currently used is integrated in the sensor with photoelectric integration, direct outputting an electrical signal to determine the collected angle value, the sensor is arranged on a conductive arm of the isolating switch with 27.5 kV, which is difficult to obtain power. 3. Potentiometer, Hall angle sensor and other angle sensors belonging to electronic sensors, arranged on the conductive arm of the isolating switch with 27.5 kV, which is also difficult to supply power and vulnerable to electromagnetic interference.

SUMMARY OF THE DISCLOSURE

In order to solve the above problems, the purpose of the present disclosure is to provide a sensor system for measuring an angle of a gate of an isolating switch of overhead lines. Based on the operating characteristics and conditions of the overhead lines' isolating switch, the principle of structural fiber optic sensors is applied to design an optical fiber angle sensor for measuring the gate angle of the isolating switch of the overhead lines. Since the optical fiber has excellent characteristics such as resistance to electromagnetic and atomic radiation interference, fine diameter, soft quality, light weight, mechanical properties, insulation, non-inductive electrical properties, water resistance, high temperature resistance, corrosion resistance, etc., the optical fiber angle sensor can meet the measurement of the gate angle of the isolating switch of the overhead lines under operating conditions.

In order to achieve the above purpose, the present disclosure provides a sensor system for measuring an angle of a gate of an isolating switch of overhead lines.

A sensor system for measuring an angle of a gate of an isolating switch of overhead lines, comprising an optical fiber angle sensor, a base, a support plate, a light source fiber, a laser transmitter, an aluminum box, a relay, a step-down power module, a control circuit board, a photoelectric converter, and a receiving optical fiber; wherein the support plate is arranged on an upper part of a pillar insulator on a side of a rotatory shaft of the gate of the isolating switch of the overhead lines, as a supporting point of the base; the optical fiber angle sensor is arranged on the base, and a rotation shaft of the optical fiber angle sensor is connected to the rotatory shaft of the gate of the isolating switch of the overhead lines to detect a rotation angle of the gate of the isolating switch of the overhead lines; the laser transmitter, the relay, the step-down power module, the control circuit board, and the photoelectric converter are arranged in the aluminum box, and the aluminum box is placed far away from the isolating switch; the laser transmitter is controlled by an opening and closing of the relay by means of the control circuit board to emit a laser beam into the light source fiber; the laser beam reflected from the light source optical fiber is received by the receiving optical fiber and transmitted to the photoelectric converter to convert a light intensity into a voltage signal to realize photoelectric conversion; the converted voltage signal is transmitted to the control circuit board for processing, and the angle of the gate collected by the optical fiber angle sensor is finally output; the step-down power module reduces 220V voltage used on a railway to two voltage levels, 12V and 5V, for powering the laser transmitter, the control circuit board, the relay, and the photoelectric converter, respectively.

The optical fiber angle sensor comprises a rotation shaft, a housing, a bracket, an optical fiber probe, and a dial; the rotation shaft passes through a top of the housing and is connected to the dial; the light source fiber and the receiving fiber extending within the housing are each connected to a corresponding fiber probe; the two fiber probes are same and each fixed on an inner wall of the housing by a corresponding bracket, the two brackets being same; a probe on the light source fiber and a probe on the receiving optical fiber are arranged in a same straight line; an opening is defined on the dial for every 1 degree; the laser beam reflected from the light source fiber irradiates the dial; when the dial is rotated by 1 degree, the laser beam from the light source fiber is directed through a corresponding opening into the optical fiber probe on the receiving optical fiber, and propagates through the receiving optical fiber to the photoelectric converter for photoelectric conversion; each optical signal received by the receiving optical fiber indicates that the rotation shaft is rotated by 1 degree; the photoelectric converter converts each optical signal into a voltage signal, which is recorded as a pulse signal; the number of the pulse signals from the photoelectric converter is recorded by the control circuit board to calculate the rotation angle of the optical fiber angle sensor.

The dial defines 360 openings, and each opening corresponds to an angle value; after the laser beam from the light source fiber passes through each opening of the dial and incident into the receiving optical fiber, the laser beam is converted into the voltage signal by the photoelectric converter to obtain a pulse corresponding to 1 degree.

The support plate comprises an aluminum plate, a hinge, a steel bar, a nut, screws, and four first screw holes; the four first screw holes are defined on the aluminum plate, such that the base is fixed on the aluminum plate; an end of the steel bar and an end of the aluminum plate are connected by the hinge, and the other end of the steel bar and the other end of the aluminum plate are connected by the nut and the screws; by controlling a distance between the screws and the nut, the support plate is fixed on the pillar insulator on the side of the rotatory shaft of the gate of the isolating switch of the overhead lines.

The base defines a U-shaped groove and second screw holes; the U-shaped groove is defined in the middle of the base, and the second screw holes are defined on two bottom sides of the base, so that the base is fixed on the aluminum plate.

The control circuit board transmits the processed gate angle of the isolating switch of the overhead lines to a personal computer of a management department for isolating gates of overhead lines through RS485 communication, so that the staff can view it.

A solution applied to the sensor system is as follows: the sensor system is initialized; when the angle of the gate is required to be measured, the control circuit board controls the relay to turn on, so that the step-down power module supplies power to the laser transmitter for emitting the laser beam into the light source fiber; the laser beam is emitted through the optical fiber probe on the light source fiber; a rotation of the gate drives the rotation shaft of the optical fiber angle sensor to rotate, causing the dial to follow to rotate; when the dial rotates a corresponding opening to just below the optical fiber probe on the light source fiber, the laser beam emitted by the optical fiber probe on the light source fiber passes through the corresponding opening of the dial and enters the optical fiber probe of the receiving optical fiber, and is transmitted to the photoelectric converter through the receiving optical fiber; the photoelectric converter converts the received each optical signal into a corresponding voltage signal, which is a corresponding pulse signal; the corresponding pulse signal is transmitted to the control circuit board, and the number of the transmitted pulse signals is counted by the control circuit board; the rotation angle of the gate is calculated by calculating the number of the pulse signals, and the rotation angle is transmitted to a computer of a management department for isolating gates of overhead lines through a RS485 communication, so that a staff is able to view the rotation angle.

Since the present disclosure adopts the principle of structural optical fiber sensor to design an optical fiber angle sensor for measuring an angle of a gate of an isolating switch of overhead lines, the structure of the number of pulses to determine the rotation angle of the gate can be obtained the following beneficial effects.

The present disclosure adopts the principle of structural optical fiber sensor to design an optical fiber angle sensor for measuring an angle of a gate of an isolating switch of overhead lines, which has excellent characteristics such as resistance to electromagnetic and atomic radiation interference, fine diameter, soft quality, light weight, mechanical properties, insulation, non-inductive electrical properties, water resistance, high temperature resistance, corrosion resistance, etc., which can meet the measurement of the gate angle of the isolating switch of the overhead lines under operating conditions. Since the optical fiber is insulated, the optical fiber angle sensor can be installed directly on the rotatory shaft of the isolating switch of overhead lines, which is convenient for power supply and more accurate for angle measurement, reduces the false detection rate, and resists electromagnetic interference, solving the defects of the existing electronic angle sensors.

DESCRIPTION OF MAIN REFERENCE NUMERALS

Figure 1:
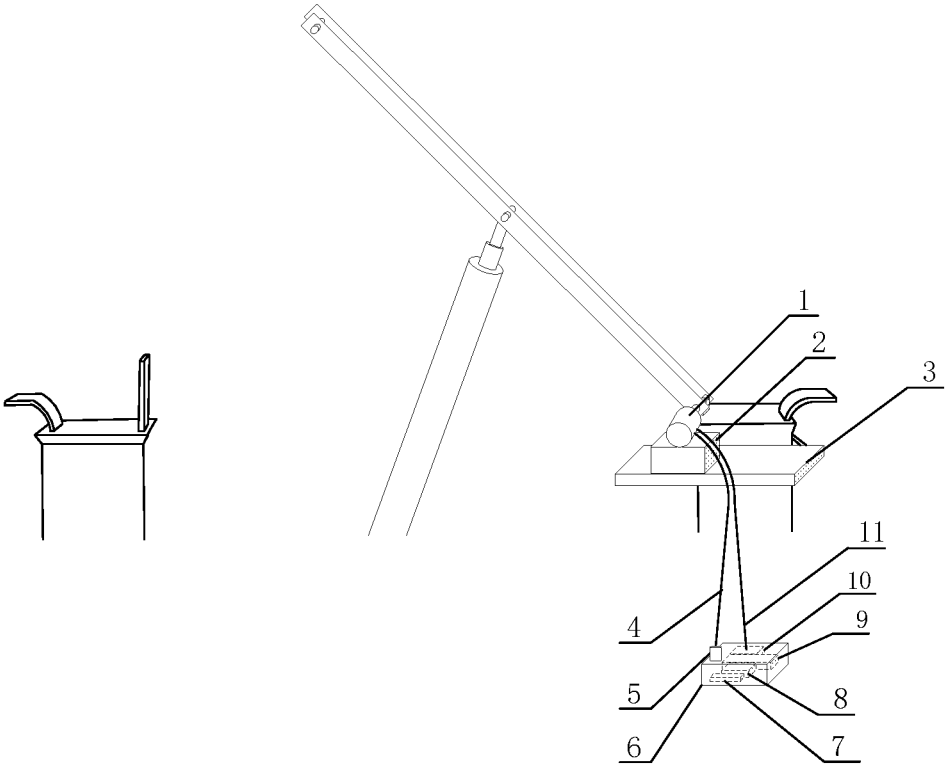
FIG. 1 is a schematic view of an installation structure of a sensor system for measuring an angle of a gate of an isolating switch of overhead lines according to an embodiment of the present disclosure.

| | | | |
|---|---|---|---|
| Optical fiber angle sensor | 1 | Base | 2 |
| Support plate | 3 | Light source fiber | 4 |
| Lase transmitter | 5 | Aluminum box | 6 |
| Relay | 7 | Step-down power module | 8 |
| Control circuit board | 9 | Photoelectric converter | 10 |
| Receiving optical fiber | 11 | Rotation shaft | 12 |
| Housing | 13 | Bracket | 14 |
| Optical fiber probe | 15 | Dial | 16 |
| Aluminum plate | 17 | Hinge | 18 |
| Steel bar | 19 | Nut | 20 |
| Screw | 21 | First screw hole | 22 |
| U-shaped groove | 23 | Second screw hole | 24 |

DETAILED DESCRIPTION

The present disclosure will be further described in detail below in conjunction with the embodiments and the accompanying drawings.

Referring to FIGS. 1 to 8 for a sensor system for measuring an angle of a gate of an isolating switch of overhead lines in the present disclosure, including an optical fiber angle sensor 1, a base 2, a support plate 3, a light source fiber 4, a laser transmitter 5, an aluminum box 6, a relay 7, a step-down power module 8, a control circuit board 9, a photoelectric converter 10, and a receiving optical fiber 11.

As shown in FIG. 1, the support plate 3 is arranged on an upper part of a pillar insulator on a side of a rotatory shaft of the gate of the isolating switch of the overhead lines, as a supporting point of the base 2. The optical fiber angle sensor 1 is arranged on the base 2, and a rotation shaft 12 of the optical fiber angle sensor 1 is connected to the rotatory shaft of the gate of the isolating switch of the overhead lines to detect a rotation angle of the gate of the isolating switch of the overhead lines. When the gate of the isolating switch of the overhead lines is being opened and closed, the gate rotates with the rotatory shaft as a center, driving the rotatory shaft to rotate, and the rotatory shaft drives the rotation shaft 12 of the optical fiber angle sensor 1 to rotate. The rotatory shaft of the gate of the isolating switch of the overhead lines and the rotation shaft 12 of the optical fiber angle sensor 1 are coaxially arranged, therefore, the rotation angle of the gate is reflected on the optical fiber angle sensor 1, thereby realizing the measurement of the gate angle. The laser transmitter 5, the relay 7, the step-down power module 8, the control circuit board 9, and the photoelectric converter 10 are arranged in the aluminum box 6, and the aluminum box 6 is placed far away from the isolating switch. The laser transmitter 5 is controlled by the opening and closing of the relay 7 by means of the control circuit board 9 to emit a laser beam into the light source fiber 4. The laser beam undergoes total reflection in the light source fiber 4, and finally the laser beam is transmitted to the optical fiber angle sensor 1. The laser beam reflected from the light source optical fiber 4 is received by the receiving optical fiber 11, and transmitted to the photoelectric converter 10 to convert a light intensity into a voltage signal to realize photoelectric conversion. The converted electrical signal is transmitted to the control circuit board 9 for processing, and the gate angle collected by the optical fiber angle sensor 1 is finally output. The step-down power module 8 reduces the 220V voltage used on the railway to two voltage levels, 12V and 5V, for powering the laser transmitter 5, the control circuit board 9, the relay 7, and the photoelectric converter 10, respectively.

Figure 2:
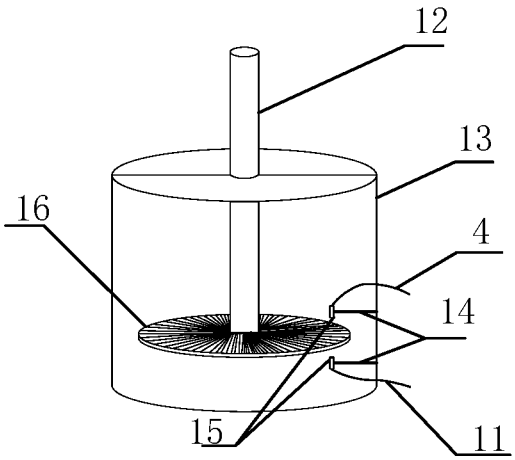
FIG. 2 is a structural schematic view of an optical fiber angle sensor of a sensor system for measuring an angle of a gate of an isolating switch of overhead lines according to an embodiment of the present disclosure.

As shown in FIG. 2, the optical fiber angle sensor 1 includes a rotation shaft 12, a housing 13, a bracket 14, an optical fiber probe 15, and a dial 16. The rotation shaft 12 passes through a top of the housing 13 and is connected to the dial 16. The light source fiber 4 and the receiving fiber 11 extending within the housing 13 are respectively connected to a corresponding fiber probe 15. The two fiber probes 15 are same and each fixed on an inner wall of the housing 13 by a corresponding bracket 14. The two brackets 14 are same. A probe on the light source fiber 4 and a probe on the receiving optical fiber 11 are arranged in a same straight line. An opening is defined on the dial 16 for every 1 degree. The laser beam reflected from the light source fiber 4 irradiates the dial 16. When the dial 16 is rotated by 1 degree, the laser beam from the light source fiber 4 is directed through a corresponding opening into the optical fiber probe 15 on the receiving optical fiber 11, and propagates through the receiving optical fiber 11 to the photoelectric converter 10 for photoelectric conversion. The light intensity signal is converted into a corresponding voltage signal. Each optical signal received by the receiving optical fiber 11 indicates that the rotation shaft 12 is rotated by 1 degree. The photoelectric converter 10 converts each optical signal into a voltage signal, which is recorded as a pulse signal. The number of voltage pulses from the photoelectric converter 10 is recorded by the control circuit board 9 to calculate the rotation angle of the optical fiber angle sensor 1.

Figure 3:
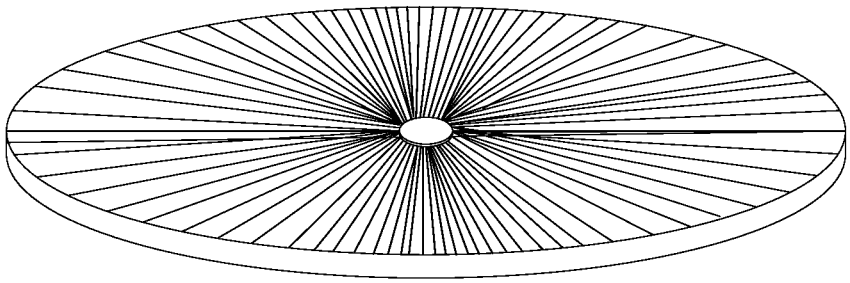
FIG. 3 is a structural schematic view of a dial of a sensor system for measuring an angle of a gate of an isolating switch of overhead lines according to an embodiment of the present disclosure.

As shown in FIG. 3, the dial 16 defines 360 openings, and each opening corresponds to an angle value. A full rotation is 360 degrees. That is, after the laser beam from the light source fiber 4 passes through the opening of the dial 16 and incident into the receiving optical fiber 11, the laser beam is converted into a voltage signal by the photoelectric converter 10 to obtain a pulse corresponding to 1 degree.

The aluminum box 6 is arranged under the isolating switch of the overhead lines and far away from the gate, to prevent the electromagnetic field from interfering with the control circuit board 9.

Figure 4:
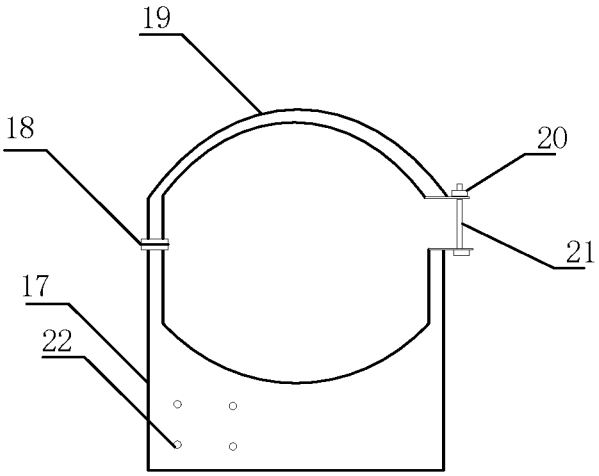
FIG. 4 is a structural schematic view of a support plate of a sensor system for measuring an angle of a gate of an isolating switch of overhead lines according to an embodiment of the present disclosure.

As shown in FIG. 4, the support plate 3 includes an aluminum plate 17, a hinge 18, a steel bar 19, a nut 20, a screw 21, and first screw holes 22. The aluminum plate 17 defines four first screw holes 22, which is convenient for the base 2 to be fixed on the aluminum plate 17. An end of the steel bar 19 and an end of the aluminum plate 17 are connected by the hinge 18, and the other end of the steel bar 19 and the other end of the aluminum plate 17 are connected by the nut 20 and the screw 21. By controlling a distance between the screw 21 and the nut 20, the support plate 3 can be fixed on the pillar insulator on the side of the rotatory shaft of the gate of the isolating switch of the overhead lines.

Figure 5:
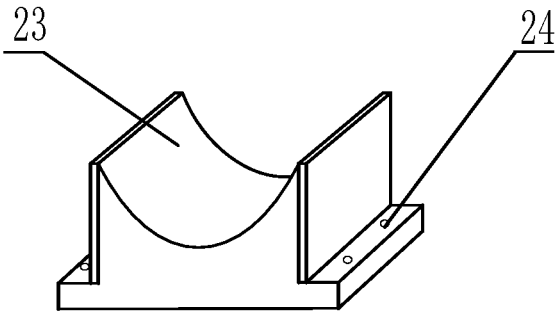
FIG. 5 is a structural schematic view of a base of a sensor system for measuring an angle of a gate of an isolating switch of overhead lines according to an embodiment of the present disclosure.

As shown in FIG. 5, the base 2 defines a U-shaped groove 23 and second screw holes 24. The U-shaped groove 23 is defined in the middle of the base 2, and the second screw holes 24 are defined on two bottom sides of the base 2, to facilitate fixing the base 2 to the support plate 3. The screws 21 pass through the first screw holes 22 and the second screw holes 24, so that the base 2 is fixed on the aluminum plate 17.

Among the two voltage levels of 12V and 5V processed by the step-down power supply module 8, the laser transmitter 5 and the control circuit board 9 are provided with 12V voltage, and the relay 7 and the photoelectric converter 10 are provided with 5V voltage.

The control circuit board 9 transmits the processed gate angle of the isolating switch of the overhead lines to a personal computer (PC) of a management department for isolating gates of overhead lines through RS485 communication, so that the staff can view it.

The PC is arranged with an upper computer for monitoring the angle of the isolating switch of the overhead lines, which is configured to check the angle of the corresponding isolating switch.

The control circuit board 9 may be a STM32F103ZET6 control board.

Figure 6:
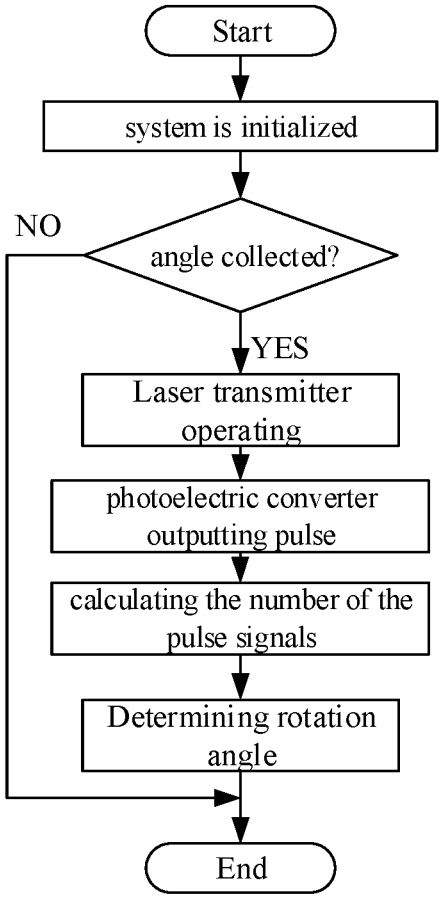
FIG. 6 is a flowchart for measuring an angle of a gate of an isolating switch applied to a sensor system for measuring an angle of a gate of an isolating switch of overhead lines according to an embodiment of the present disclosure.

As shown in FIG. 6, a solution of the present disclosure for measuring for measuring an angle of a gate of an isolating switch of overhead lines is as follows: the system is initialized; when the angle of the gate is required to be measured, the control circuit board 9 controls the relay 7 to turn on, so that the step-down power module 8 supplies power to the laser transmitter 5 for emitting a laser beam into the light source fiber 4, which is emitted through the optical fiber probe 15 on the light source fiber 4; the rotation of the gate drives the rotation shaft 12 of the optical fiber angle sensor 1 to rotate, causing the dial 16 to follow to rotate; when the dial 16 rotates one of the openings to just below the optical fiber probe 15 on the light source fiber 4, the laser beam emitted by the optical fiber probe 15 on the light source fiber 4 passes through the opening of the dial 16 and enters the optical fiber probe 15 of the receiving optical fiber 11, and is transmitted to the photoelectric converter 10 through the receiving optical fiber 11; the photoelectric converter 10 converts the received optical signal into a corresponding voltage signal, which is a pulse signal; the pulse signal is transmitted to the control circuit board 9, and the number of transmitted pulse signals is counted by the control circuit board 9; the rotation angle of the gate is calculated by calculating the number of the pulse signals, and the angle is transmitted to the PC of the management department for isolating gates of overhead lines through RS485 communication, so that the staff can view it.

Figure 7:
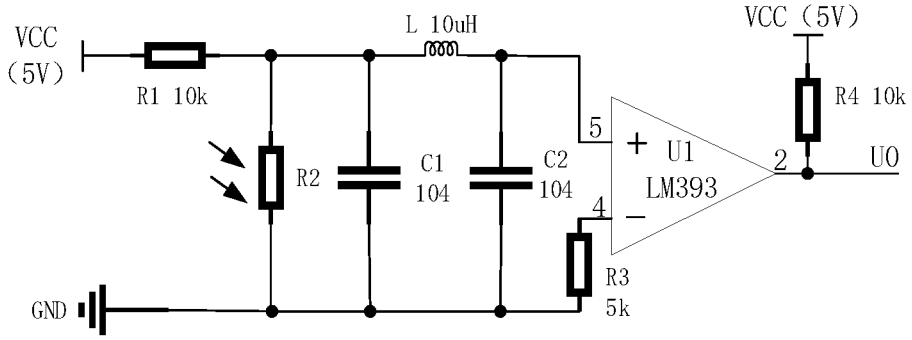
FIG. 7 is a schematic circuit view of a photoelectric converter of a sensor system for measuring an angle of a gate of an isolating switch of overhead lines according to an embodiment of the present disclosure.
Figure 8:
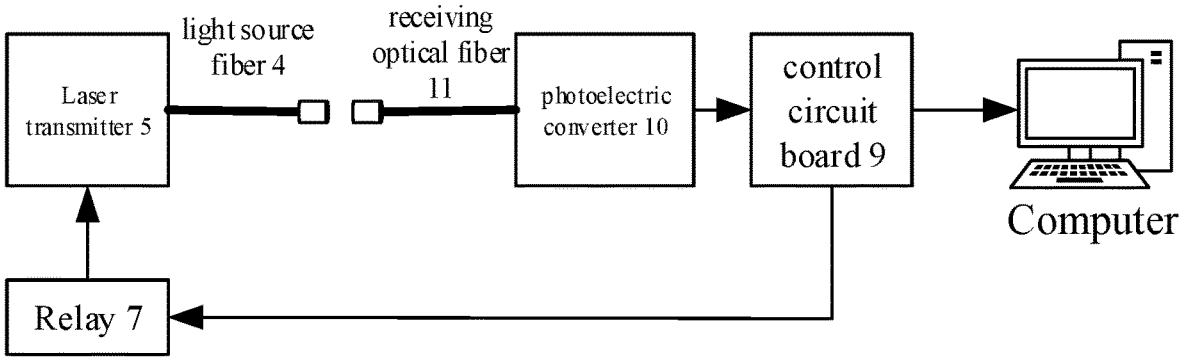
FIG. 8 is a working principle view of a sensor system for measuring an angle of a gate of an isolating switch of overhead lines according to an embodiment of the present disclosure.

As shown in FIG. 7, the photoelectric converter 10 is arranged with a photoelectric conversion circuit, including a first resistor R1, a photoresistor R2, a third resistor R3, a fourth resistor R4, a first capacitor C1, an inductor L, a second capacitor C2, and a four-way differential comparator U1. The photoresistor R2 and the first capacitor C1 are connected in parallel between the first resistor R1 and the inductor L. The other end of the first resistor R1 is connected to a VCC of 5V voltage after stepping down by the step-down power module 8. The second capacitor C2 is connected in series between the other end of the inductor L and a GND of 5V voltage after stepping down by the step-down power module 8. The 5V voltage after the step-down power module 8 is divided by the first resistor R1 to a circuit of photoresistor R2 in parallel with the first capacitor C1. The photoresistor R2 senses the optical signal received by the receiving optical fiber 11 and converts the optical signal into a corresponding resistance value. The resistance change of the photoresistor R2 causes the voltage change of the photoresistor R2, and the changed voltage is used as an electrical signal to pass through a LC-π filter circuit composed of the first capacitor C1, the inductor L, and the second capacitor C2, and transmitted to the four-way differential comparator U1 for performing voltage comparison. When the photoresistor R2 detects the optical signal from the receiving optical fiber 11, an output Pin 2 of the of the four-way differential comparator U1 outputs a high level, that is, a pulse. After the Pin 2 of the four-way differential comparator U1 is connected to a corresponding pin of the control circuit board 9, the pulse signal can be transmitted to the control circuit board 9. A non-inverting input Pin 5 of the four-way differential comparator U1 is connected to the other end of the inductor L. The third resistor R3 is connected in series between an inverting input Pin 4 of the four-way differential comparator U1 and the GND of 5V voltage after stepping down by the step-down power module 8. The fourth resistor R4 is connected in series between the VCC of 5V voltage after stepping down by the step-down power module 8 and the output Pin 2 of the four-way differential comparator U1.

The working principle and working process of the present disclosure are as follows.

As shown in 8, when the gate angle is required to be measured, the control circuit board 9 controls the relay 7 to turn on, so that the step-down power supply module 8 supplies power to the laser transmitter 5 for emitting a laser beam into the light source fiber 4, which is emitted through the optical fiber probe 15 on the light source fiber 4; the rotation of the gate drives the rotation shaft 12 of the optical fiber angle sensor 1 to rotate, causing the dial 16 to follow to rotate; when the dial 16 rotates one of the openings to just below the optical fiber probe 15 on the light source fiber 4, the laser beam emitted by the optical fiber probe 15 on the light source fiber 4 passes through the opening of the dial 16 and enters the optical fiber probe 15 of the receiving optical fiber 11, and is transmitted to the photoelectric converter 10 through the receiving optical fiber 11; the photoelectric converter 10 converts the received optical signal into a corresponding voltage signal, which is a pulse signal; the pulse signal is transmitted to the control circuit board 9, and the number of transmitted pulse signals is counted by the control circuit board 9; the rotation angle of the gate is calculated by calculating the number of the pulse signals, and the angle is transmitted to the PC of the management department for isolating gates of overhead lines through RS485 communication, so that the staff can view it.

What is claimed is:

1. A sensor system for measuring an angle of a gate of an isolating switch of overhead lines, comprising an optical fiber angle sensor, a base, a support plate, a light source fiber, a laser transmitter, an aluminum box, a relay, a step-down power module, a control circuit board, a photoelectric converter, and a receiving optical fiber; wherein the support plate is arranged on an upper part of a pillar insulator on a side of a rotatory shaft of the gate of the isolating switch of the overhead lines, as a supporting point of the base; the optical fiber angle sensor is arranged on the base, and a rotation shaft of the optical fiber angle sensor is connected to the rotatory shaft of the gate of the isolating switch of the overhead lines to detect a rotation angle of the gate of the isolating switch of the overhead lines; the laser transmitter, the relay, the step-down power module, the control circuit board, and the photoelectric converter are arranged in the aluminum box, and the aluminum box is placed far away from the isolating switch; the laser transmitter is controlled by an opening and closing of the relay by means of the control circuit board to emit a laser beam into the light source fiber; the laser beam reflected from the light source optical fiber is received by the receiving optical fiber and transmitted to the photoelectric converter to convert a light intensity into a voltage signal to realize photoelectric conversion; the converted voltage signal is transmitted to the control circuit board for processing, and the angle of the gate collected by the optical fiber angle sensor is finally output;

the optical fiber angle sensor comprises a rotation shaft, a housing, a bracket, an optical fiber probe, and a dial; the rotation shaft passes through a top of the housing and is connected to the dial; the light source fiber and the receiving fiber extending within the housing are each connected to a corresponding fiber probe; the two fiber probes are same and each fixed on an inner wall of the housing by a corresponding bracket, the two brackets being same; a probe on the light source fiber and a probe on the receiving optical fiber are arranged in a same straight line; an opening is defined on the dial for every 1 degree; the laser beam reflected from the light source fiber irradiates the dial; when the dial is rotated by 1 degree, the laser beam from the light source fiber is directed through a corresponding opening into the optical fiber probe on the receiving optical fiber, and propagates through the receiving optical fiber to the photoelectric converter for photoelectric conversion; each optical signal received by the receiving optical fiber indicates that the rotation shaft is rotated by 1 degree; the photoelectric converter converts each optical signal into a voltage signal, which is recorded as a pulse signal; the number of the pulse signals from the photoelectric converter is recorded by the control circuit board to calculate the rotation angle of the optical fiber angle sensor;

the dial defines 360 openings, and each opening corresponds to an angle value; after the laser beam from the light source fiber passes through each opening of the dial and incident into the receiving optical fiber, the laser beam is converted into the voltage signal by the photoelectric converter to obtain a pulse corresponding to 1 degree;

the support plate comprises an aluminum plate, a hinge, a steel bar, a nut, screws, and four first screw holes; the four first screw holes are defined on the aluminum plate, such that the base is fixed on the aluminum plate;

an end of the steel bar and an end of the aluminum plate are connected by the hinge, and the other end of the steel bar and the other end of the aluminum plate are connected by the nut and the screws; by controlling a distance between the screws and the nut, the support plate is fixed on the pillar insulator on the side of the rotatory shaft of the gate of the isolating switch of the overhead lines;

the step-down power module is configured to reduce 220V voltage used on a railway to two voltage levels, 12V and 5V, for powering the laser transmitter and the control circuit board with 12V voltage and powering the relay and the photoelectric converter with 5V voltage;

the photoelectric converter is arranged with a photoelectric conversion circuit comprising a first resistor, a photoresistor, a third resistor, a fourth resistor, a first capacitor, an inductor, a second capacitor, and a four-way differential comparator; the photoresistor and the first capacitor are connected in parallel between an end of the first resistor and an end of the inductor; the other end of the first resistor is connected to a VCC of 5V voltage after stepping down by the step-down power module; the second capacitor is connected in series between the other end of the inductor and a GND of 5V voltage after stepping down by the step-down power module; the 5V voltage after the step-down power module is divided by the first resistor to a circuit of photoresistor in parallel with the first capacitor; the photoresistor is configured to sense the each optical signal received by the receiving optical fiber and converts the each optical signal into a corresponding resistance value; a resistance change of the photoresistor causes a voltage change of the photoresistor, and a changed voltage is used as an electrical signal to pass through a LC-π filter circuit composed of the first capacitor, the inductor, and the second capacitor, and transmitted to the four-way differential comparator for performing voltage comparison; when the photoresistor detects the each optical signal from the receiving optical fiber, an output Pin 2 of the four-way differential comparator outputs a high level, that is, the pulse; after the output Pin 2 of the four-way differential comparator is connected to a corresponding pin of the control circuit board, the pulse signal is transmitted to the control circuit board; a non-inverting input Pin 5 of the four-way differential comparator is connected to the other end of the inductor; the third resistor is connected in series between an inverting input Pin 4 of the four-way differential comparator and the GND of 5V voltage after stepping down by the step-down power module; the fourth resistor is connected in series between the VCC of 5V voltage after stepping down by the step-down power module and the output Pin 2 of the four-way differential comparator.

2. The sensor system according to claim 1, wherein the base defines a U-shaped groove and second screw holes; the U-shaped groove is defined in the middle of the base, and the second screw holes are defined on two bottom sides of the base; the screws pass through the first screw holes and the second screw holes, so that the base is fixed on the aluminum plate.

3. The sensor system according to claim 1, wherein a solution applied to the sensor system is as follows: the sensor system is initialized; when the angle of the gate is required to be measured, the control circuit board controls the relay to turn on, so that the step-down power module supplies power to the laser transmitter for emitting the laser beam into the light source fiber; the laser beam is emitted through the optical fiber probe on the light source fiber; a rotation of the gate drives the rotation shaft of the optical fiber angle sensor to rotate, causing the dial to follow to rotate; when the dial rotates a corresponding opening to just below the optical fiber probe on the light source fiber, the laser beam emitted by the optical fiber probe on the light source fiber passes through the corresponding opening of the dial and enters the optical fiber probe of the receiving optical fiber, and is transmitted to the photoelectric converter through the receiving optical fiber; the photoelectric converter converts the received each optical signal into a corresponding voltage signal, which is a corresponding pulse signal; the corresponding pulse signal is transmitted to the control circuit board, and the number of the transmitted pulse signals is counted by the control circuit board; the rotation angle of the gate is calculated by calculating the number of the pulse signals, and the rotation angle is transmitted to a computer of a management department for isolating gates of overhead lines through a RS485 communication, so that a staff is able to view the rotation angle.

* * * * *